US006302068B1

(12) United States Patent
Moyer

(10) Patent No.: US 6,302,068 B1
(45) Date of Patent: Oct. 16, 2001

(54) FAST ACTING ENGINE VALVE CONTROL WITH SOFT LANDING

(76) Inventor: David Franklin Moyer, 5 Weatherby Rd., Hanover, NH (US) 03755-1923

( * ) Notice: Subject to any disclaimer, the term of this patent is extended or adjusted under 35 U.S.C. 154(b) by 0 days.

(21) Appl. No.: 09/585,778

(22) Filed: Jun. 5, 2000

Related U.S. Application Data

(63) Continuation-in-part of application No. 09/519,635, filed on Mar. 6, 2000.

(51) Int. Cl.[7] ..... F01L 9/04; F01L 13/00

(52) U.S. Cl. ..... 123/90.11; 123/90.16; 123/90.39; 123/90.65

(58) Field of Search ..... 123/90.11, 90.15, 123/90.16, 90.39, 90.65

(56) References Cited

U.S. PATENT DOCUMENTS

| | | | | |
|---|---|---|---|---|
| 3,969,614 | * | 7/1976 | Moyer et al. | 123/480 |
| 4,094,275 | * | 6/1978 | Auiler et al. | 123/552 |
| 4,222,354 | | 9/1980 | Uitvlugt . | |
| 4,227,494 | | 10/1980 | Uitvlugt . | |
| 4,230,076 | | 10/1980 | Mueller . | |
| 4,256,070 | | 3/1981 | Mueller . | |
| 4,777,915 | | 10/1988 | Bonvallet . | |
| 4,857,003 | * | 8/1989 | Hafner et al. | 123/90.16 |
| 4,870,930 | * | 10/1989 | Yagi | 123/90.11 |
| 4,917,056 | * | 4/1990 | Yagi et al. | 123/90.16 |
| 4,930,463 | * | 6/1990 | Hare, Sr. | 123/90.11 |
| 5,529,549 | * | 6/1996 | Moyer | 477/189 |
| 5,544,626 | | 8/1996 | Diggs . | |
| 5,653,198 | | 8/1997 | Diggs . | |
| 5,695,430 | * | 12/1997 | Moyer | 477/189 |
| 5,730,091 | * | 3/1998 | Diehl et al. | 123/90.11 |
| 5,832,885 | * | 11/1998 | Moyer | 123/90.16 |
| 5,893,344 | * | 4/1999 | Church | 123/90.16 |
| 5,975,052 | * | 11/1999 | Moyer | 123/406.23 |
| 5,992,390 | * | 11/1999 | Moyer | 123/198 F |
| 6,006,706 | * | 12/1999 | Kanzaki | 123/90.16 |
| 6,062,201 | * | 5/2000 | Nozawa et al. | 123/90.16 |

* cited by examiner

*Primary Examiner*—Weilun Lo

(57) ABSTRACT

This invention describes an engine valve control responsive to electrical signals from a controller to open and close valves. Power to move the valves comes from a conventional camshaft. A disabler spring is compressed by a cam lobe and held compressed by a first solenoid, and the valve is held from opening by a second solenoid. When the second solenoid releases the valve, a ½ oscillation between the disabler spring and valve spring opens the valve and a third solenoid holds the valve open. The first solenoid then releases the disabler spring. When the third solenoid releases the valve spring, a ½ oscillation of the two springs closes the valve with a soft landing and the second solenoid again holds the valve closed. The valve operation is very fast, independent of engine speed, and can be controlled over 270 crankshaft degrees. The solenoids, used for holding only, are very small and require little power. The camshaft runs at crankshaft speed. By disabling the cylinders during compression and expansion strokes, 4 stroke operation is used for gasoline motor operation. 2 stroke operation is used for compressor and air motor operation as a pneumatic hybrid.

7 Claims, 2 Drawing Sheets

FAST ACTING ENGINE VALVE CONTROL WITH SOFT LANDING

CROSS-REFERENCE TO RELATED APPLICATIONS

This application is a continuation in part which discloses and claims subject matter disclosed in my earlier pending application Ser. No. 09/519,635 filed on Mar. 6, 2000. This continuation describes improvements to the valve disabler operation in the previous application which may be applied to the hybrid internal combustion engine as well.

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The present invention relates to the field of internal combustion engines, more particularly to a method of controlling the engine intake and exhaust valves so as to produce a more efficient combustion process within the cylinder and to operate the engine as a pneumatic hybrid.

This invention describes a method for increasing the flexibility of the present valve control. While the general principles and teachings disclosed are applicable to all valve controlled internal combustion engines, the invention is hereinafter described in detail in connection with its application to a reciprocating, cam and valve, multi-cylinder engine.

The poppet valve driven by a camshaft has been used in the internal combustion engine for many years. Modifications to the valve train have been developed to permit changing the valve timing while the engine is in operation. When the timing control prevents the valves from opening during an engine cycle, the cylinder is disabled, and the effect of a variable displacement engine is obtained. The advantage of a variable displacement engine is that when less than maximum efficiency power is required, some of the cylinders may be disabled and the remaining active cylinders' power is increased so that they will operate at greater efficiency, while the engine output remains constant. This approach has had limited success in practice because the usual control activates or deactivates half the number of cylinders, and this abrupt change in output torque causes poor drivability. Furthermore, the disabling mechanism is relatively slow acting so that more than one revolution of the crankshaft is required to make the change.

All of the differences cited with the prior art referenced in my previous application (Ser. No. 09/519,635) apply to the present invention. In addition, there have been camless engine valves developed which eliminate the camshaft, and power the valves with solenoid devices under the control of a computer. These valves tend to be heavy, noisy, and consume large amounts of electrical power, primarily because they utilize magnetic force to move the valves.

One example of these camless valve trains is shown in U.S. Pat. No. 5,199,392 issued to Kreuter et al on Apr. 6, 1993. In order to lessen the solenoid force required to move the valve, three springs are used with the lower two having a combined force equal and opposite to the upper spring with the valve midway between the open and closed positions. The third spring has been added to bias the total spring forces toward the valve closed position and assure a constant neutral point over the service life of the assembly. In addition to the solenoids having to deliver the energy required for the initial spring compression, they must also supply the frictional energy required by each valve operation. The differential spring pressure accelerates the moving mass to the mid (equilibrium) point of the travel and then the opposite differential spring pressure decelerates the moving mass. The system frictional energy reduces the amplitude of spring oscillation each time, so the frictional energy must be supplied by the solenoid towards which the mass is moving. Since the solenoid attractive force increases as the air gap decreases, this results in an impact of the moving mass on the stationary magnet face and or the valve seat. The solenoid electrical energy comes from the fuel powering the engine while driving an electrical generator with its additional losses.

The present invention supplies the energy to move the valves by the more efficient method of a cam compressing a spring. Much lower power electromagnets are used which merely hold and release the valve elements without moving them. The cam compresses the spring to store the additional frictional energy required for both the opening and closing oscillations.

An effort to soften the impact on the magnets and valve seats is shown in U.S. Pat. No. 5,730,091 issued to Diehl et al on Mar. 24, 1998. This invention uses two plates with three electromagnets and 3 springs and provides for a partially open valve position and reduced impacts. These additional components increase the mass and friction of the moving elements of the system, requiring more power from the electromagnets. Partial opening of the valve increases the flow losses across the valve opening and is less desirable than the full opening for one half the open time. The impact reduction is achieved by the third spring resisting the valve spring but with no damping means to handle the transient oscillation between the two springs.

The present invention uses the conventional cam and rocker arm to move the valve. It uses a disabling spring to store the cam energy for release by the electromagnets and stores enough cam energy to provide for the friction losses. A pneumatic damper is employed to absorb the disabling spring reset energy.

U.S. Pat. No. 5,868,108 issued Feb. 9, 1999, to Schmitz et al is another attempt to give a solenoid operated engine valve a "soft" landing. This approach controls the magnetic field strength as the armature approaches the stator by changing the coil ampere-turns to match the reset spring force. It is very difficult to accomplish this control in light of the non-linear relationship of the magnet attractive force versus the spring force and the natural oscillation resulting from their interaction. With the addition of the spring (9), this non-linearity will be difficult to control, especially when the engine speed requires rapid valve action.

In the present invention, the oscillatory action between the two springs will be uniform and repeatable without the need for magnet control. The magnetic attraction is used only for sealing the seating of the armature when the springs have closed the magnetic circuit at the end of an oscillatory excursion.

U.S. Pat. No. 4,917,056 issued Apr. 17, 1990 to Yagi et al describes a valve control having a separate spring which is compressed by the cam directly in a manner similar to the present invention. The fourteenth embodiment (FIG. 36) of that invention has the greatest similarity to the present invention. This embodiment has the valve spring (11), disabler spring (113), hydraulic damper (117), and holding electromagnet (A1) of all the other embodiments and in addition has a second holding electromagnet (A2). This patent does not employ an oscillatory exchange of energy between the springs as does the present invention, but rather a direct force from the cam through the disabler spring and the damper to the valve spring. When the electromagnet A1 releases the valve, any oscillatory energy exchange is suppressed by the damper. Therefore, the A1 release merely opens the valve (as quickly as allowed by the damper) to the opening called for by the cam profile, unlike the immediate full opening of the present invention. In a similar manner, the early closing of the valve described merely releases the valve (only after it has reached the full open position and is latched) from the full open position to that allowed by the cam profile at that time and the valve does not fully close until the usual time. In the present invention, the valve opens rapidly (no damper), independent of engine speed, to the full open position and fully closes rapidly (no damper), again independent of engine speed.

The fluid in the hydraulic damper must be adjusted to accommodate changing engine speeds since the inertia forces depend upon cam speed. In the present invention, the pneumatic damper for spring reset needs no such adjustment since it is fixed by the release of a spring compressed to the same point independent of speed.

It is not possible with these embodiments to operate the valve outside of the range of the cam lobe. With a pneumatic hybrid, it is desirable to operate the engine as an air motor and thus utilize braking energy to propel the vehicle. If the catalyst is to be protected from the exhaust of the air motor, it is necessary to interchange the valve functions so that the intake valve may be opened on the exhaust stroke and the exhaust valve opened on the intake stroke. The present invention has this capability because the cam energy is stored in the disable spring before valve operation is required.

BRIEF SUMMARY OF THE INVENTION

The object of this invention is to improve the response of the engine intake and exhaust valves to electrical signals of the engine controller which direct a valve to open or close. A further object is for the valves to respond rapidly and be independent of engine speed. A further object is have the valves operate with minimum opening and closing impact, noise, and vibration. A further object is to be able to open and close the valves anywhere within at least 270 degrees of each crankshaft rotation and the camshaft to rotate at crankshaft speed to facilitate 2 cycle compressor and air motor operation of the engine. A further object is to have the power to move the valves supplied from the camshaft in the manner of a conventional camshaft/poppet valve engine.

The invention accomplishes these objects by having the cam compress a disabler spring during a portion of crankshaft rotation where the valve will not be required to operate. Electromagnet #1 (EM1) holds the valve in the closed position while electromagnet #3 (EM3) holds the disabler spring at the point of maximum compression by the cam lobe. The energy contained in this spring is sufficient to accelerate the valve and its valve spring to its full open position, including the friction energy required during the opening and closing of the valve. When the engine controller (preferably a computer) calls for the opening of the valve, EM1 is released and the energy of the disabler spring is delivered to the valve spring. At the end of this delivery, the valve will have reached the full open position at zero velocity, and electromagnet #2 (EM2) will hold the valve in this open position. Immediately after EM2 seizes the valve, EM3 is released and the disabler spring expands to its maximum length. When the controller calls for the closing of the valve, EM2 is released and the valve spring delivers its energy to the disabler spring. At the end of this delivery, the valve will have reached the closed position at zero velocity and EM1 again holds the valve in its closed position. The disabler spring is now in its original energy state and length and awaits the energy from the cam lobe for the next valve operation.

Since valve disablement does not require any valve operation during the engine cycle, the camshaft is operated at crankshaft speed and the cylinders are disabled during the compression and expansion strokes of the 4 cycle gas engine operation. During the engine operation as a compressor and air motor, 2 cycle operation may be used.

DETAILED DESCRIPTION OF THE INVENTION

Figure 1:
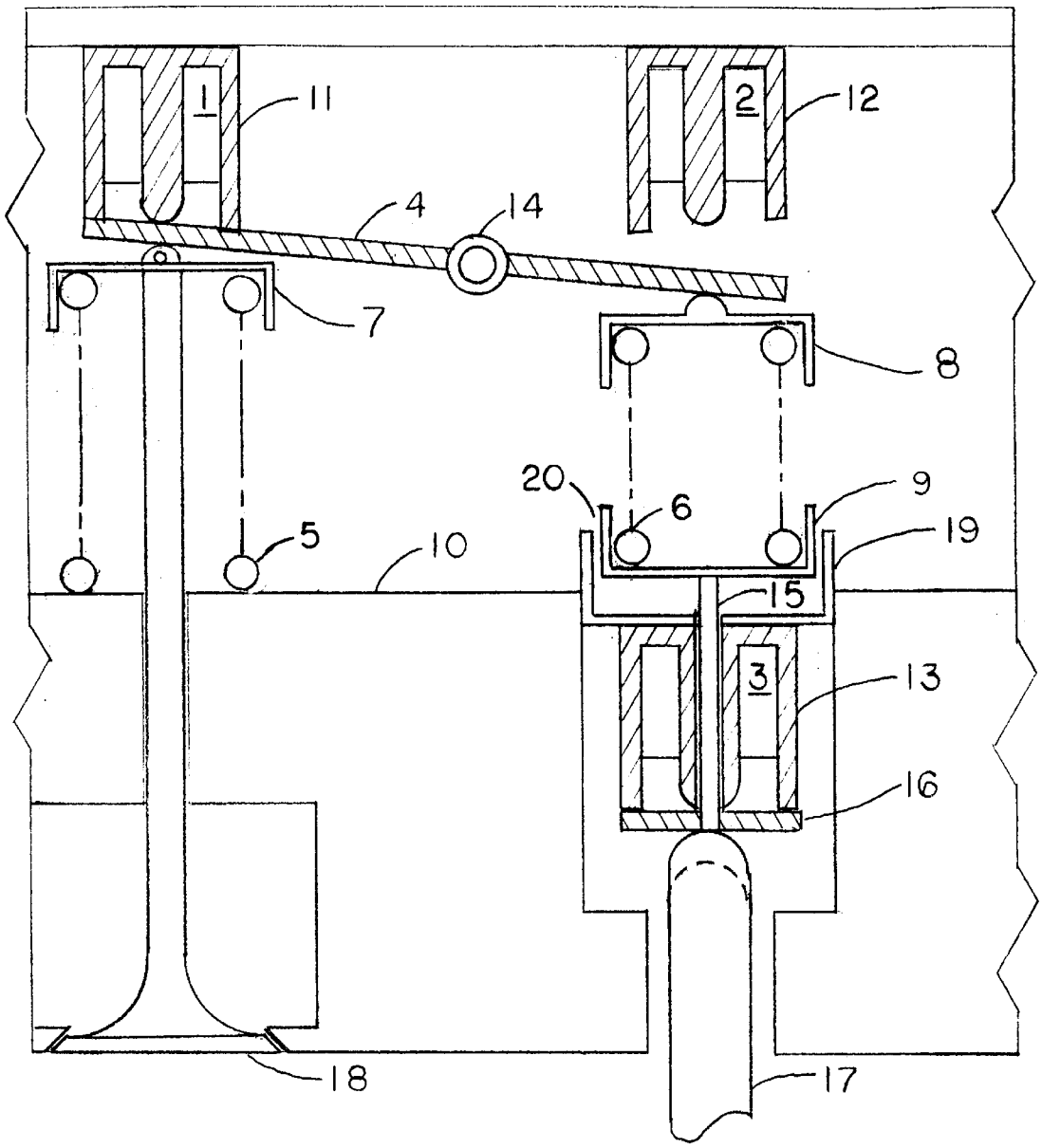
FIG. 1 is a schematic representation of the valve disabler elements at the time when the push rod has compressed the disabler spring.

This invention involves controlling the energy transfer between the valve spring and a disabler spring, with three solenoids which hold and release the valve train components. In both FIG. 1 and FIG. 2, the solenoids 11, 12, and 13 consist of coils 1, 2, and 3, with cylindrical cores and outside cylindrical casings of magnetic material. The cores have rounded ends to increase the flux density and insure high holding strength with minimum ampere-turns resulting in low power requirements. Each coil is fitted with a reverse diode suitable for absorbing the magnetic energy when the electromagnet is deactivated in order to provide quick release of the holding force. The rocker arm 4 serves as the armature for solenoids 11 and 12, while the armature 16 serves solenoid 13 directly. Carrier rod 15 is non-magnetic and serves to connect armature 16 to spring carrier 9 for solenoid 13.

FIG. 1 shows push rod 17 actuated by a cam lobe (not shown). There is a cam with a lobe for each valve on the common camshaft (not shown). Push rod 17 has compressed disabler spring 6 by pushing armature 16 to the stator of solenoid 13 while solenoid 11 is activated. This is accomplished in the same manner as in a conventional engine with the cam lobe accelerating the valve for the initial part of the cam action and then allowing the valve spring to decelerate the valve to zero speed at its maximum opening. At this point, the valve spring is fully compressed and now accelerates the valve towards the closed position. As the valve approaches closure, the lobe decelerates the valve and provides a "soft landing" on the valve seat. In the present invention, a pneumatic dashpot provides the "soft landing" for the disabler spring and the deceleration portion of the lobe is omitted.

The disabler spring 6 decelerates the spring carrier 9, the carrier rod 15, and the solenoid armature 16 to the point where the armature 16 contacts the solenoid 13 stator at zero (or very low) speed and the coil 3 seals the magnetic circuit.

With solenoids 11 and 13 activated and disabler spring 6 fully compressed, the valve will open whenever the controller deactivates solenoid 11. Until that deactivation, the cylinder will be disabled (assuming a like condition with the other cylinder valve) for as long as necessary to achieve the desired average torque. Push rod 17, is held against armature 16 by a light follower spring (not shown). It moves between the position shown and the dotted line position during disabler spring 6 compression.

Figure 2:
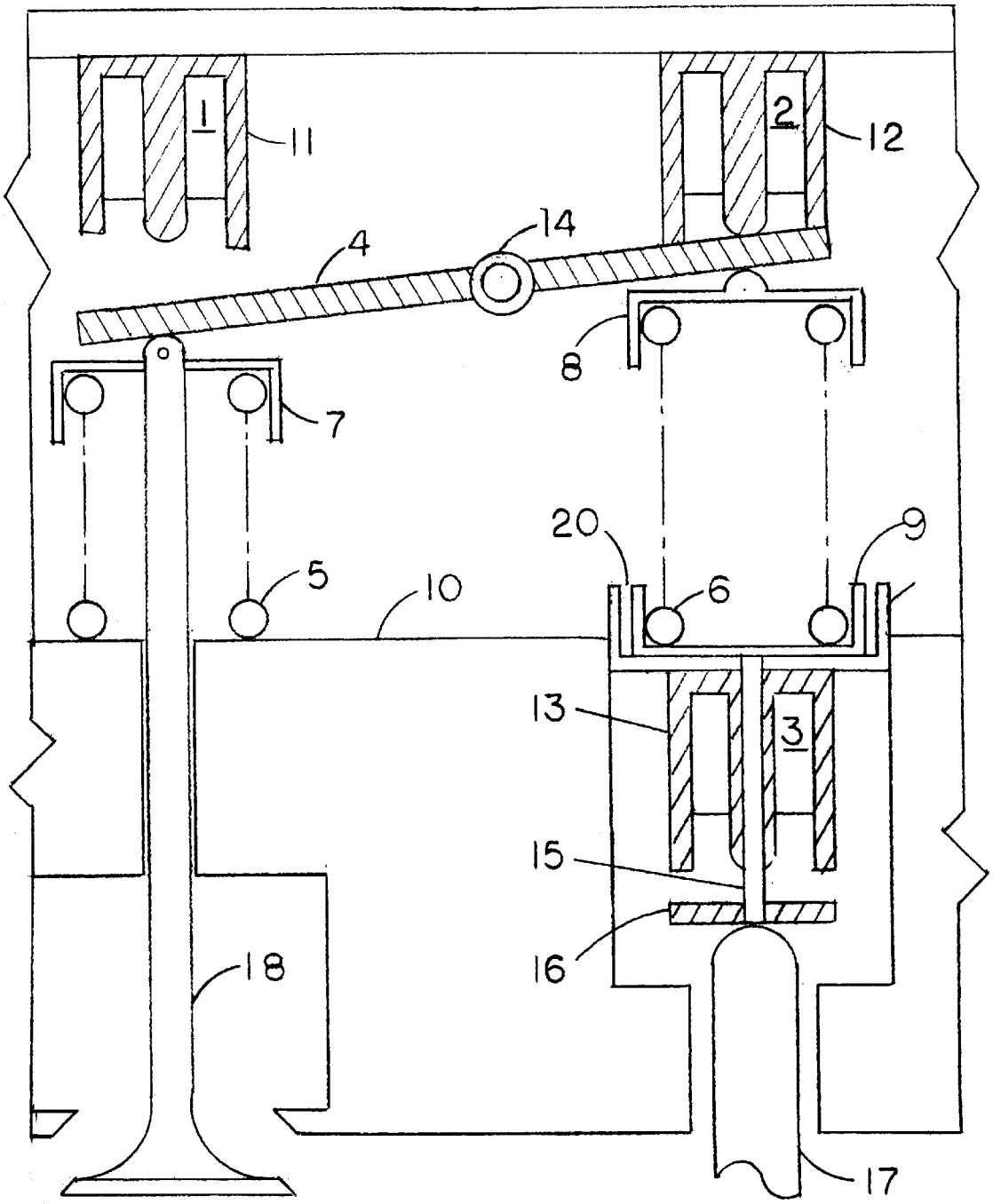
FIG. 2 is a schematic representation of the valve disabler elements at the time after the disabler spring has opened the valve and its holding magnet has released it to full length.

When the controller deactivates solenoid 11, the energy in disabler spring 6 is transferred to valve spring 5 through the rocker arm 4, and valve 18 fully opens. The ratio of the lengths of the rocker arm segments from the pivot point 14 to the end determines the relative spring rates of the disabler and valve springs. The springs' constructions and rates are chosen so that they will exchange energy in an oscillatory manner, achieving similar accelerations and decelerations in each exchange. This will assure maximum speed of valve operation with a "soft landing" at each extreme of the oscillation. The disabler spring end of rocker arm 4 reaches solenoid 12 at zero (or very low) speed, and coil 2 seals the magnetic circuit. When the rocker arm 4 is sealed in position, solenoid 13 is released so that the disabler spring 6 expands to its maximum length. During this expansion, spring carrier 9 is forced into pneumatic dashpot 19, expelling air through dashpot orifice 20. This absorbs the spring energy delivered by the expansion of disabler spring 6. FIG. 2 shows the position of all the disabler elements at this time.

The controller calls for valve closure by deactivating solenoid 12. This causes valve spring 5 to transfer its energy to the expanded disabler spring 6, allowing valve 18 to reach the closed position at zero (or very low) speed and be held there by activation of solenoid 11. The next time the cam lobe comes around and causes push rod 17 to compress disabler spring 6, the condition shown in FIG. 1 is again reached.

At no time during this valve action is any solenoid called upon to deliver energy to the moving elements. Springs 5 and 6 have the same effective rate of energy storage (through rocker arm 4 motion ratio). With no friction in the system, the two springs could exchange their energy and oscillate indefinitely. Their ability to perform each ½ oscillation repeatedly is made possible by the additional energy (for friction) being stored in disabler spring 6 when its initial compression is greater than that of valve spring 5 at its maximum compression. In a like manner, disabler spring 6 is expanded before valve closure so that valve spring 5 in its fully compressed state (valve fully open) contains more energy than the disabler spring 6 compressed at valve closure to allow for the frictional energy of valve closure.

Only the initial compression of disabler spring 6 is dependent upon engine speed, and the springs must be sized to decelerate the solenoid armature 16 to zero speed at the maximum engine speed. All the valve actions will be engine speed independent with very rapid maximum initial accelerations and "soft" decelerated landings. The energy to move the valve elements will be delivered by the time-proven cam and lobe.

While the invention has been shown and described in one preferred embodiment, it will be clear to those skilled in the art that other embodiments such as placing the disabler spring at the rocker arm pivot point 14, or direct cam action through the disabler spring to the valve stem and other configurations will also benefit from this invention.

I claim:

1. A valve operating system for each cylinder valve of an internal combustion engine comprising:

a common camshaft containing one cam for each valve, each said cam having at least one lobe with means for compressing a disabler spring;

at least one said disabler spring with means of opening an engine valve;

at least one valve spring with means of closing said engine valve;

a means by which said valve spring and said disabler spring may exchange energy;

a first electromagnet with means for holding said disabler spring in compression;

a second electromagnet with means for holding said engine valve in a closed position;

a third electromagnet with means for holding said engine valve in an opened position;

an engine controller with means to separately activate all said electromagnets;

said engine controller with means to separately deactivate all said electromagnets.

2. The engine valve operating system of claim 1 wherein said disabler spring and said valve spring are similar in construction and operation and whose spring rates are equalized by said means of energy exchange between them.

3. The engine valve operating system of claim 1 wherein said disabler spring has energy storage means sufficient to open said engine valve while delivering energy to said valve spring.

4. The engine valve operating system of claim 1 wherein said valve spring has energy storage means sufficient to close said engine valve while delivering energy to an expanded said disabler spring.

5. The engine valve operating system of claim 1 wherein said lobe has said compressing means sufficient to deliver the energy to open and close said engine valve and overcome the friction involved in said valve operations.

6. The engine valve operating system of claim 1 wherein said electromagnets have a rounded center pole with means to intensify the magnetic holding force.

7. The engine valve operating system of claim 1 wherein a pneumatic dashpot provides means for absorbing said disabler spring energy when released by said first electromagnet.

* * * * *